US007044299B2

(12) United States Patent
Nagoya

(10) Patent No.: US 7,044,299 B2
(45) Date of Patent: May 16, 2006

(54) CLEANING APPARATUS

(75) Inventor: Yoshiki Nagoya, Tokyo (JP)

(73) Assignee: Marna Inc., Tokyo (JP)

( * ) Notice: Subject to any disclaimer, the term of this patent is extended or adjusted under 35 U.S.C. 154(b) by 0 days.

(21) Appl. No.: 10/746,880

(22) Filed: Dec. 22, 2003

(65) Prior Publication Data

US 2005/0000837 A1 Jan. 6, 2005

(30) Foreign Application Priority Data

Jul. 4, 2003 (JP) ..... P2003-271019

(51) Int. Cl.
*B65D 83/10* (2006.01)
*A47B 81/02* (2006.01)
*A46B 17/02* (2006.01)

(52) U.S. Cl. ..... 206/361; 206/487; 211/65; 248/110

(58) Field of Classification Search ..... 206/361, 206/209, 362.2, 362.3, 581, 15.2, 15.3, 486, 206/487; 211/65; 248/110, 111, 113; 15/143.1, 15/146, 184, 160, 106; D4/116; D6/551
See application file for complete search history.

(56) References Cited

U.S. PATENT DOCUMENTS 1,091,993 A * 3/1914 White et al. ..... 15/184
D103,358 S * 2/1937 Illsche ..... D6/551
2,933,751 A * 4/1960 Brownstein ..... 15/257.01
3,759,375 A * 9/1973 Nappi ..... 206/362
D297,292 S * 8/1988 Plymale ..... D6/551
5,170,893 A * 12/1992 Smith ..... 211/40
5,772,015 A * 6/1998 Musiel et al. ..... 206/209
6,116,414 A * 9/2000 Discko, Jr. ..... 206/229
D491,404 S * 6/2004 Dotterman et al. ..... D6/551
2004/0108242 A1* 6/2004 Seehoff ..... 206/581
2004/0129580 A1* 7/2004 Cochran et al. ..... 206/15.2

FOREIGN PATENT DOCUMENTS

EP 329938 A1 * 8/1989
GB 2342572 A * 4/2000
JP 11313782 A * 11/1999

* cited by examiner

*Primary Examiner*—Mickey Yu
*Assistant Examiner*—J. Gregory Pickett
(74) *Attorney, Agent, or Firm*—Flynn, Thiel, Boutell & Tanis, P.C.

(57) ABSTRACT

There is provided a cleaning apparatus which is made up of a hand brush 11 and a box 16. The hand brush 11 has a thick plate 13 provided with a brush part 12 around a peripheral surface thereof, and a grip bar 14 connected to a portion of the peripheral surface of the thick plate 13 at the head edge thereof. The grip bar 14 has an engage part 15 at each side of a head portion thereof. Each engage part 15 protrudes in an axial direction. The box 16 has a peripheral wall 17 and a bottom wall 18. The periphery wall 17 is provided with engage grooves 19 at an inner surface thereof. Each engage groove 19 receives the engage part 15 at a position where a head edge of the brush part 12 of the hand brush 11 makes no contact with the bottom wall 18.

2 Claims, 4 Drawing Sheets

CLEANING APPARATUS

BACKGROUND OF THE INVENTION

1. Field of the Invention

This invention relates to a cleaning apparatus comprising a hand brush and a box.

2. Description of the Prior Art

A cleaning apparatus used especially for cleaning a toilet bowl comprises a hand brush and a box, and after use, the hand brush is placed in the box in a way to drain water and to dry quickly, and is placed at a corner, for example, of a toilet.

A primary structure of such a cleaning apparatus is that the hand brush, which comprises a grip bar having a brush part at the head thereof and a flange at the base thereof, is placed in a box such that a periphery of the flange is fit in an upper portion of the box.

In this combination, the lengths of the box and the hand brush are relatively fixed not to contact the head edge of the brush part to the bottom wall of the box. By having the head edge of the brush part float above the bottom wall, the brush part is promoted to drain water contained therein and dries quickly.

Primarily, it is desired that such a cleaning apparatus is small in size because if the box in particular is large, the apparatus becomes an obstacle in a narrow space, such as a toilet or a lavatory.

According to the structure of the prior art as described above, the flange is provided at the base portion of the grip, so that a distance between the flange and the head edge of the brush part becomes long, and that a height of the box becomes long as well in order to effectively drain water off the brush part by providing a space between the brush part and the box. This necessitates a larger size of the apparatus.

Although it is possible to make the box smaller in length by providing the flange near the head of the grip, a base portion of the grip bar becomes heavier unbalancing the weight of the grip bar, which makes the apparatus easy to fall down. Further, it is difficult to handle the hand brush since the flange is provided at the head of the grip.

Therefore, it is an object of this invention to solve the problems of the above-described prior art and to provide a cleaning apparatus which comprises a box having a smaller size.

SUMMARY OF THE INVENTION

There is provided a cleaning apparatus which comprises a hand brush 11 and a box 16. The hand brush 11 comprises a thick plate 13 provided with a brush part 12 around a peripheral surface thereof, and a grip bar 14 connected to a portion of the peripheral surface of the thick plate 13 at the head edge thereof. The grip bar 14 comprises an engage part 15 at each side of the head portion thereof. Each engage part 15 protrudes in an axial direction of the box 16. The box 16 comprises a peripheral wall 17 and a bottom wall 18. The peripheral wall 17 is provided with engage grooves 19 at an inner surface thereof. Each engage groove 19 receives the corresponding engage part 15 at a position where a head edge of the brush part 12 of the hand brush 11 does not contact with the bottom wall 18.

The cleaning apparatus may be constructed such that the engage groove 19 is beveled by gradually enlarging the width thereof toward an upper direction. The cleaning apparatus may also be constructed such that two engage grooves 19 are provided adjacently as a pair in an inner surface of the peripheral wall 17.

According to the invention, there are obtained various effects. The box can be made smaller in size and is slimmed down, so that a smaller space is required for the placement of the apparatus. It is easy to drain water contained in the brush part and it has good air permeability. The brush part is well dried so that it is sanitary.

BRIEF DESCRIPTION OF THE INVENTION

DESCRIPTION OF PREFERRED EMBODIMENT

Figure 1:
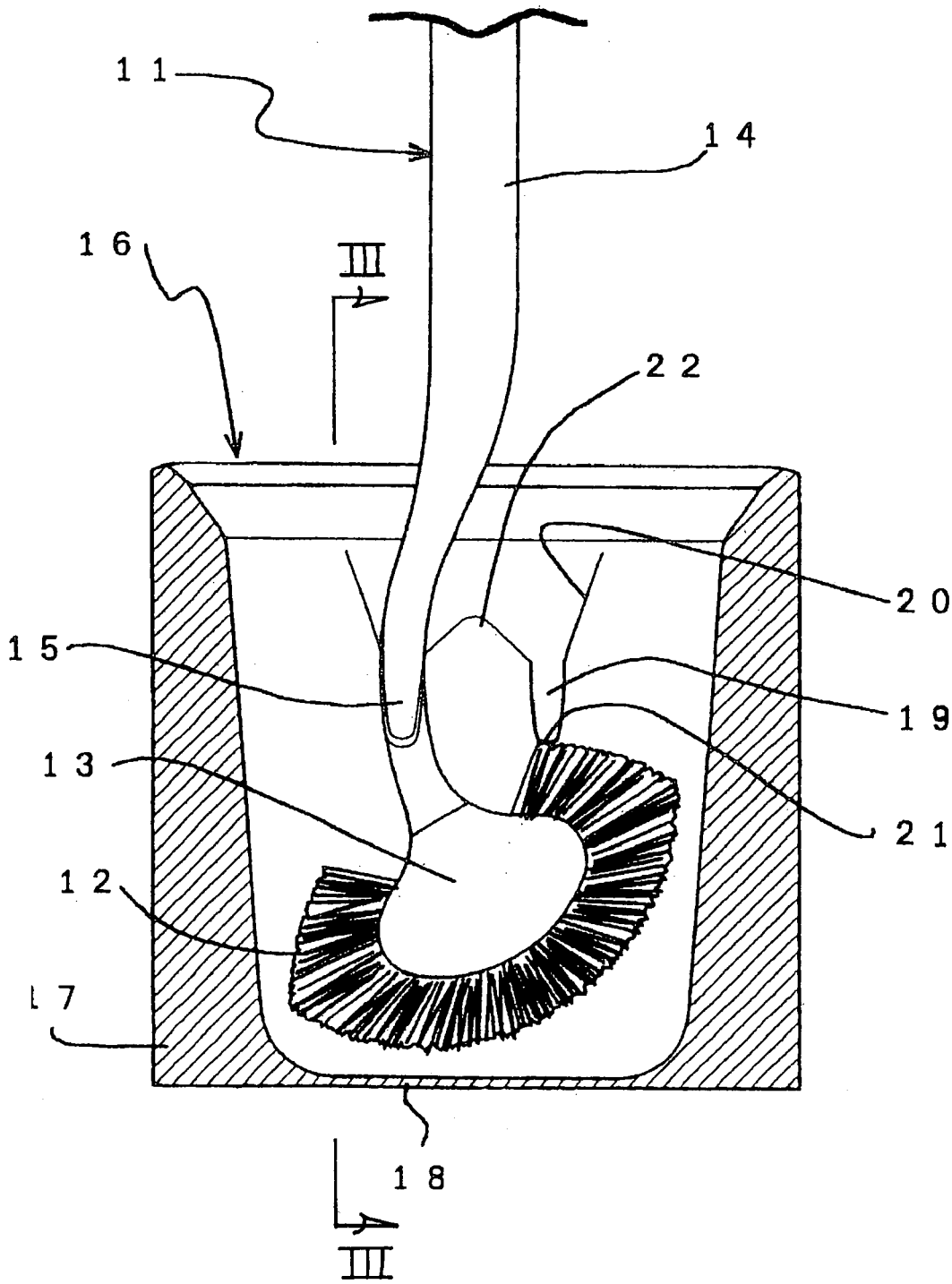
FIG. 1 is a sectional view along a major axis of a box showing a hand brush placed into a box according to the invention.
Figure 2:
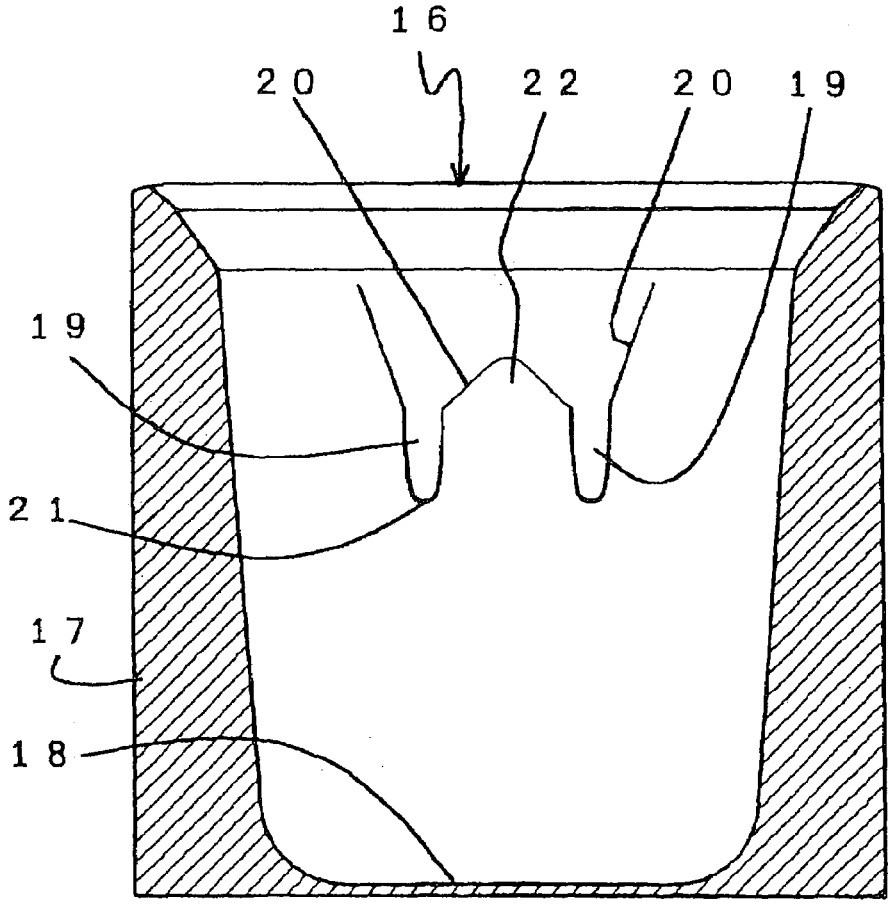
FIG. 2 is a sectional view along a major axis of a box showing a box according to the invention.

According to an embodiment of the invention, a hand brush 11 comprises a thick plate 13 having a roughly discoidal shape and is provided with a brush part 12 around a peripheral surface thereof. A grip bar 14 having a curved head portion at the head portion thereof is connected to a portion of the peripheral surface of the thick plate 13. There is provided an engage part 15 at each side of the head portion of the grip bar 14 along an axial direction of the thick plate 13.

As illustrated in the drawings, the engage part 15 is formed such that the head portion of the grip bar 14 is narrowed in width while providing a step at an opposite side facing the front direction.

Although the brush part 12 is provided around the peripheral surface of the thick plate 13, except a portion where the head edge of the grip bar 14 is connected, it is provided radiantly from a center of the discoidally formed thick plate 14, so nearly no portion of the brush part 12 projects in an axial direction of the thick plate 13. Further, the grip bar 14 is formed flat in width except a portion where the engage parts 15 are provided, so that a width of the hand brush 11 is withheld within a width of the thick plate 13, thereby forming a flat and slim figure.

The box 16 comprises a peripheral wall 17 and a bottom wall 18 forming a tubular box having an upper portion which is widely opened. According to this illustrated embodiment, the box 16 is ellipsoidal and planiform in a plan view having a major axis and a minor axis where the former is 2.3 times the latter. There is provided an engage groove 19 at each inner surface which faces with each other at both sides of the major axis. Each engage groove 19 receives an engage part 15 which enters into the engage groove 19 from the top to the bottom.

Figure 3:
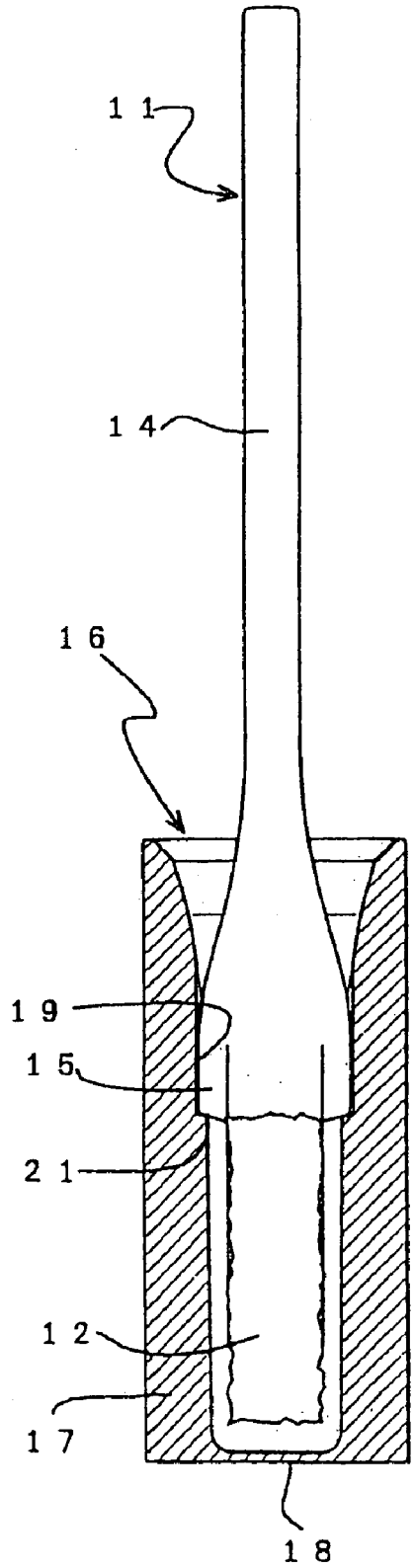
FIG. 3 is a sectional view along a minor axis of a box showing a hand brush placed into a box according to the invention.
Figure 4:
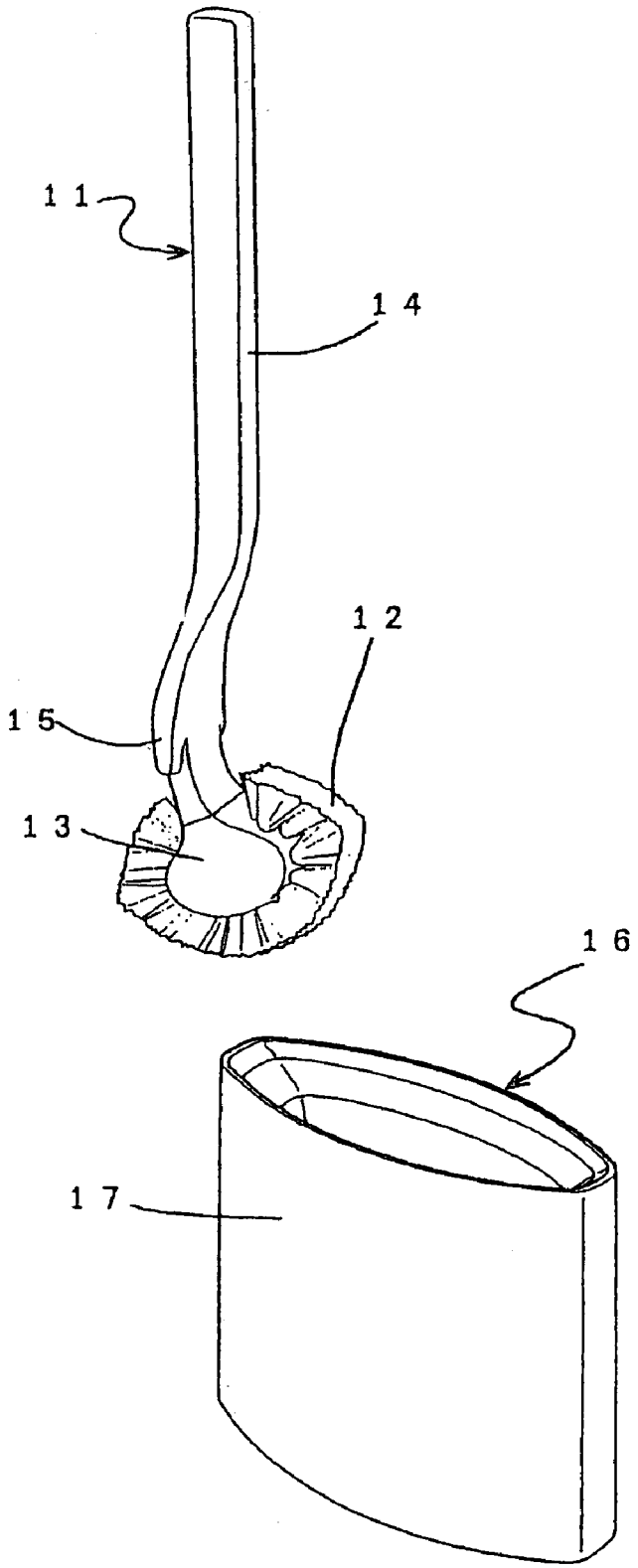
FIG. 4 is a perspective view showing a cleaning apparatus according to the invention.

Each engage groove 19 comprises a slanted wall 20 at each upper side which gradually widens the width length between both slanted walls 20 in the upper direction, while it comprises an engage step 21 at the bottom for engaging the engage part 15 on the step 21. In this composition, it is structured such that the head edge of the brush part 12 does not contact the bottom wall 18 of the box 16. As illustrated in FIGS. 1 and 3, a distance between the head edge of the brush part 12 and the engage part 15, as well as that of the bottom wall 18 and the engage step 21, are both fixed in order to improve the performance in draining water contained in the brush part 12 to dry.

Two engage grooves 19, 19 are provided adjacently at each inner surface of the peripheral wall 17 as a pair, forming a mount-shaped step 22 by slanted walls 20, 20 of the engage grooves 19, 19.

Therefore, according to this structure, when the hand brush 11 is inserted into the box 16 from the upper portion thereof, which is widely open, the engage parts 15, 15, the portions mostly protruding in side directions of the hand brush 11, engage with the engage grooves 19, 19 as they are guided by the slanted walls 20, 20 while making contact with the inner walls of the box 16. After the hand brush 11 further moves down, each engage part 15 rides on the corresponding engage step 21. Further, as described above, both the hand brush and the box 16 are planiform in a plane view, so that while the hand brush 11 is inserted into the box 16, the directivity of the hand brush 11 and the box 16 is regulated as a radial direction of the thick plate 13 of the hand brush 11 forcibly corresponds to a major axis of the box 16.

It is because the head portion of the grip bar 14 of the hand brush 11 is curved a little and the brush part 12 makes contact with the narrow inner walls, which are directed along the minor axis of the box 16, depending on the direction the hand brush 11 is inserted.

Therefore, as described above, by forming a pair of engage grooves adjacently, despite the planiform hand brush 11 being inserted into the box 16 in either direction, each engage part 15 is guided by the mount-shaped step 22 and successfully engages with the corresponding engage groove 19. For that reason, it is not needed to adjust the direction of insertion when inserting the hand brush 11 into the box 16.

Each engage groove 19 is formed in the inner surface of the peripheral wall 17 in a vertical direction, so that by engaging the engage part 15 with the engage groove 19, the hand brush 11 is prevented from falling down by losing its balance even though the engage parts 15, 15 are provided at the head portion of the hand brush 11. Therefore, the height of the box 16 can be held to a minimum.

The embodiment described above and illustrated in the drawings aims particularly at a brush for a toilet use, but the invention is not limited to such a use and is expected to be used in any other field as a cleaning tool.

I claim:

1. A cleaning apparatus comprising a hand brush and a container for storing the hand brush, said hand brush comprising a thick plate having a brush part provided around a peripheral surface thereof and a grip bar connected to a peripheral surface of the thick plate at a head edge thereof, said grip bar having an engage portion provided on opposite sides of a head portion thereof and protruding in a lateral direction, and said container comprising a peripheral wall and a bottom wall, said peripheral wall having grooves for engaging with said grip bar engage portions provided at opposite sides of an inner surface thereof, each groove being beveled by gradually increasing in width along a vertical direction thereof and receiving said grip bar engage portion at a position such that a head edge of the brush part does not come into contact with the bottom wall, said grooves being provided as pairs of adjacent grooves having a groove portion provided between the adjacent grooves for guiding the grip bar engage portions into one or the other of the adjacent grooves.

2. The cleaning apparatus of claim 1, wherein said groove portion has a peak-shaped upper end.

* * * * *